US005961046A

United States Patent [19]

Joubran

[11] Patent Number: 5,961,046

[45] Date of Patent: Oct. 5, 1999

[54] SHOWER FIXTURE WITH INNER/OUTER SPRAY RING

[76] Inventor: Raymond Joubran, 2345 Galbreth Rd, Pasadena, Calif. 91104

[21] Appl. No.: 09/060,114

[22] Filed: Apr. 14, 1998

Related U.S. Application Data

[63] Continuation-in-part of application No. 08/760,588, Dec. 4, 1996, abandoned.

[51] Int. Cl.[6] ..... B05B 1/32; B05B 15/02; B05B 1/14

[52] U.S. Cl. ..... 239/107; 239/446; 239/449; 239/460; 239/558

[58] Field of Search ..... 239/452, 456, 239/460, 446, 449, 106, 107, 558, 559

[56] References Cited

U.S. PATENT DOCUMENTS

| | | | |
|---|---|---|---|
| 1,849,517 | 3/1932 | Fraser | 239/460 |
| 1,934,553 | 11/1933 | Mueller et al. | 239/460 |
| 2,085,854 | 7/1937 | Hathaway et al. | 239/460 X |
| 2,096,912 | 10/1937 | Morris . | |
| 2,285,831 | 6/1942 | Pennypacker . | |
| 2,935,265 | 5/1960 | Richter | 239/460 X |
| 2,949,242 | 8/1960 | Blumberg et al. . | |
| 3,580,513 | 5/1971 | Martin . | |
| 3,647,144 | 3/1972 | Parkinson et al. | 239/456 |
| 3,762,648 | 10/1973 | Deines et al. . | |
| 3,801,019 | 4/1974 | Trenary . | |
| 3,997,116 | 12/1976 | Moen . | |
| 4,129,257 | 12/1978 | Eggert . | |
| 4,190,207 | 2/1980 | Fienhold et al. . | |
| 4,203,550 | 5/1980 | On . | |
| 4,303,201 | 12/1981 | Elkins et al. . | |
| 4,398,669 | 8/1983 | Fienhold et al. . | |
| 4,669,666 | 6/1987 | Finkbeiner | 239/456 X |
| 4,754,928 | 7/1988 | Rogers et al. . | |
| 5,201,468 | 4/1993 | Freier et al. . | |
| 5,398,872 | 3/1995 | Joubran . | |

FOREIGN PATENT DOCUMENTS

| | | | |
|---|---|---|---|
| 3706320 | 3/1988 | Germany . | |
| 1111126 | 4/1968 | United Kingdom | 239/460 |

*Primary Examiner*—Kevin Weldon
*Attorney, Agent, or Firm*—Mayer, Brown & Platt

[57] ABSTRACT

A shower fixture of the present invention has an inner/outer spray ring. More specifically, the shower fixture employs a spray ring which defines plurality of grooves on the inner and outer circumferences thereof. The grooves have varying notch angles to produce water sprays in varying directions. The shower fixture of the present invention also employs a spray ring retainer which has a ring portion and multiple legs extending from the ring portion. The ring portion supports the spray ring from the bottom of the spray ring. The shower fixture of the present invention is capable of producing shower sprays of varying intensities and directions.

16 Claims, 7 Drawing Sheets

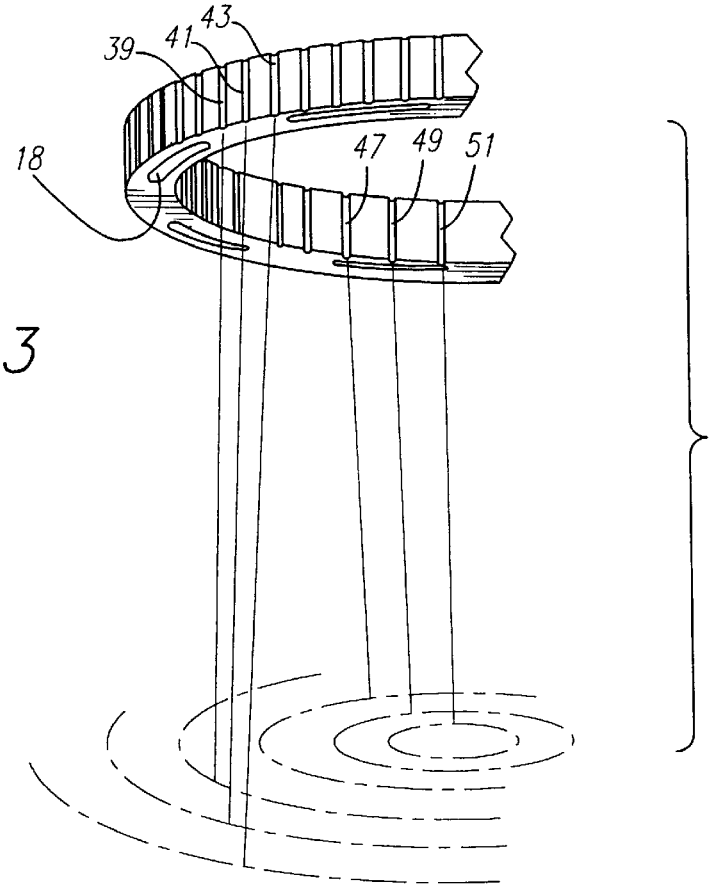
FIG. 3
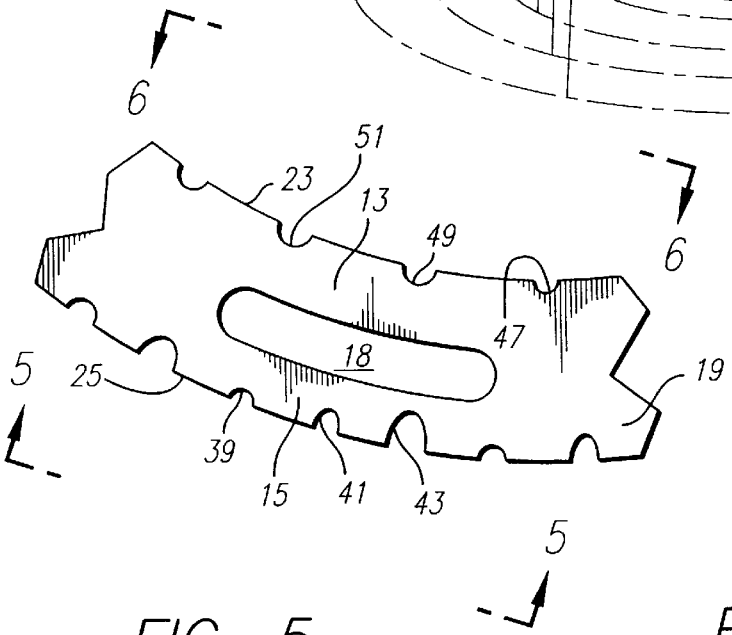
FIG. 4
FIG. 5
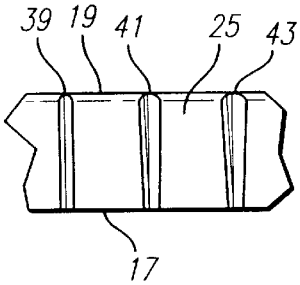
FIG. 6
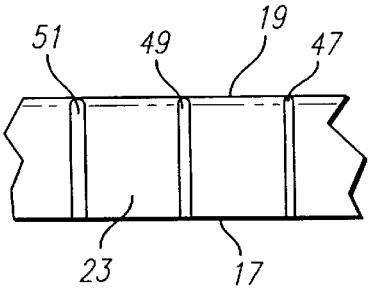

SHOWER FIXTURE WITH INNER/OUTER SPRAY RING

This application is a continuation-in-part of Ser. No. 08/760,588 now abandoned.

BACKGROUND OF THE INVENTION

1. Field of the Invention

The present invention relates to a shower fixture having a spray ring which defines grooves along both its inner and outer edges to direct water inwardly and outwardly from the spray ring, respectively. The present invention also relates to a shower fixture having a spray ring with a flush position which allows water-born sediments, calcium and the like to be flushed out, and to a cam mechanism which supports the spray ring.

2. Background

A shower head directs water from a shower fixture to a user in a stream or spray. Adjustable shower heads permit the user to select a wide variety of shower spray options. For example, a user may select a "fine" spray that distributes water in thin streams. Similarly, a user may select increasingly stronger sprays that distribute water in stronger, thicker streams. Fine sprays are often used to provide gentle rinsing action over a wide area. Strong sprays are used to provide intense massage action to one particular area.

Strong massage sprays are produced by directing all water flow through a central opening in the shower head. Fine spray is often produced by using a spray ring disposed in the shower head. A spray ring is a circular ring coupled axially beneath the shower head. The spray ring is usually coupled to the shower head by its inner edge. The inner edge grips a portion of the shower head and permits water to flow along the outer edge of the ring. The ring includes several grooves along its outer edge. The grooves are angled away from the ring so as to permit water flowing from the shower head to diverge outwardly from the shower head. The varying combinations of angles causes different spray patterns to emerge from the spray ring.

Prior art spray rings, however, are generally limited to producing diverging spray patterns—those patterns that cause water to flow outwardly from the spray ring. Thus, the spray patterns of prior art spray rings often include a large center point that lacks water spray.

Accordingly, it is an object of this invention to provide a spray ring capable of causing water to flow inwardly from the spray ring.

It is also an object of this invention to provide a spray ring capable of producing varying-intensity sprays.

In addition, the conventional spray rings have no means to eliminate built up residues from water such as calcium. Normally, the shower head must be taken apart to be cleaned. Therefore, it is another object of the present invention to provide a shower fixture with a spray ring which has a flush position to eliminate sediments and particles from the water paths.

SUMMARY OF THE INVENTION

The present invention is directed to a shower fixture, such as a handheld type or a fixed shower head, having a spray ring capable of causing water to flow inwardly from the spray ring. The spray ring of the present invention further provides sprays of varying directions and intensity.

In particular, the spray ring includes an inner circumference and an outer circumference coupled to the inner circumference. The spray ring is coupled to a shower head by a group of apertures disposed circumferentially around the spray ring between the inner and outer circumferences via a spray ring retainer and a cam ring. The spray ring includes a group of grooves disposed along the inner diameter and a second group of grooves disposed along the outer diameter of the spray ring. The group of grooves along the inner diameter includes three different sets of grooves, each set of grooves having differing angles from the axis of the spray ring. Similarly, the group of grooves along the outer diameter includes three different sets of grooves having differing angles from the center axis. Each groove has a tapering depth that produces sprays of varying widths. As the spray ring is moved up and down, the water flow enters the grooves at narrower or wider portions to produce the variable-width and intensity sprays.

The use of apertures along the circumference obviates the need to use the inner circumference for coupling. Accordingly, grooves may be placed along the inner circumference to produce a spray that converges inwardly. Further, the tapering depth of the grooves allows the spray ring to produce coarse or fine sprays.

The present invention also provides a cam mechanism including a cam ring which is operatively connected with the spray ring, and by turning a selection knob, which through the cam mechanism translates the rotation to a lateral movement of the spray ring, laterally displaces the spray ring to a flush position where sediments and water deposits can be flushed out with water.

A more complete understanding of the shower fixture having the spray ring will be afforded to those skilled in the art, as well as a realization of additional advantages and objects thereof, by a consideration of the following detailed description of the preferred embodiment. Reference will be made to the appended sheets of drawings which will first be described briefly.

BRIEF DESCRIPTION OF THE DRAWINGS

FIG. 3 is a perspective view of water flowing through the spray ring of the present invention;

FIG. 4 is a partial top view of the spray ring of FIG. 3;

FIG. 5 is a view taken along the line 5—5 of FIG. 4;

FIG. 6 is a view taken along the line 6—6 of FIG. 4;

DETAILED DESCRIPTION OF THE PREFERRED EMBODIMENT

Reference will now be made in detail to the preferred embodiments of the invention, examples of which are illustrated in the accompanying drawings. Wherever possible, the same reference numbers will be used throughout the drawings to refer to the same or like parts.

Figure 1:
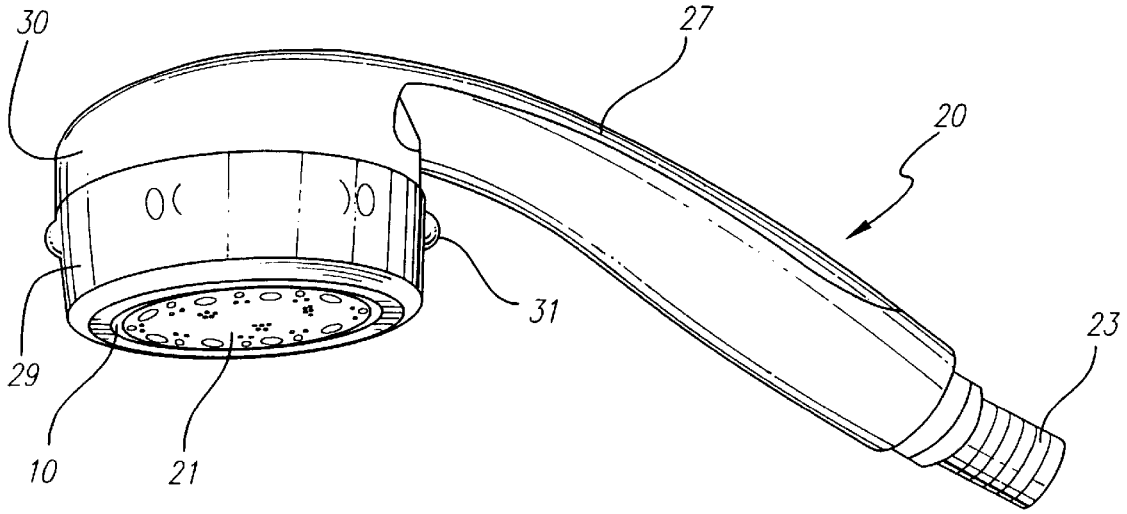
FIG. 1 is a perspective view of a handheld shower having a spray ring according to the present invention.
Figure 11:
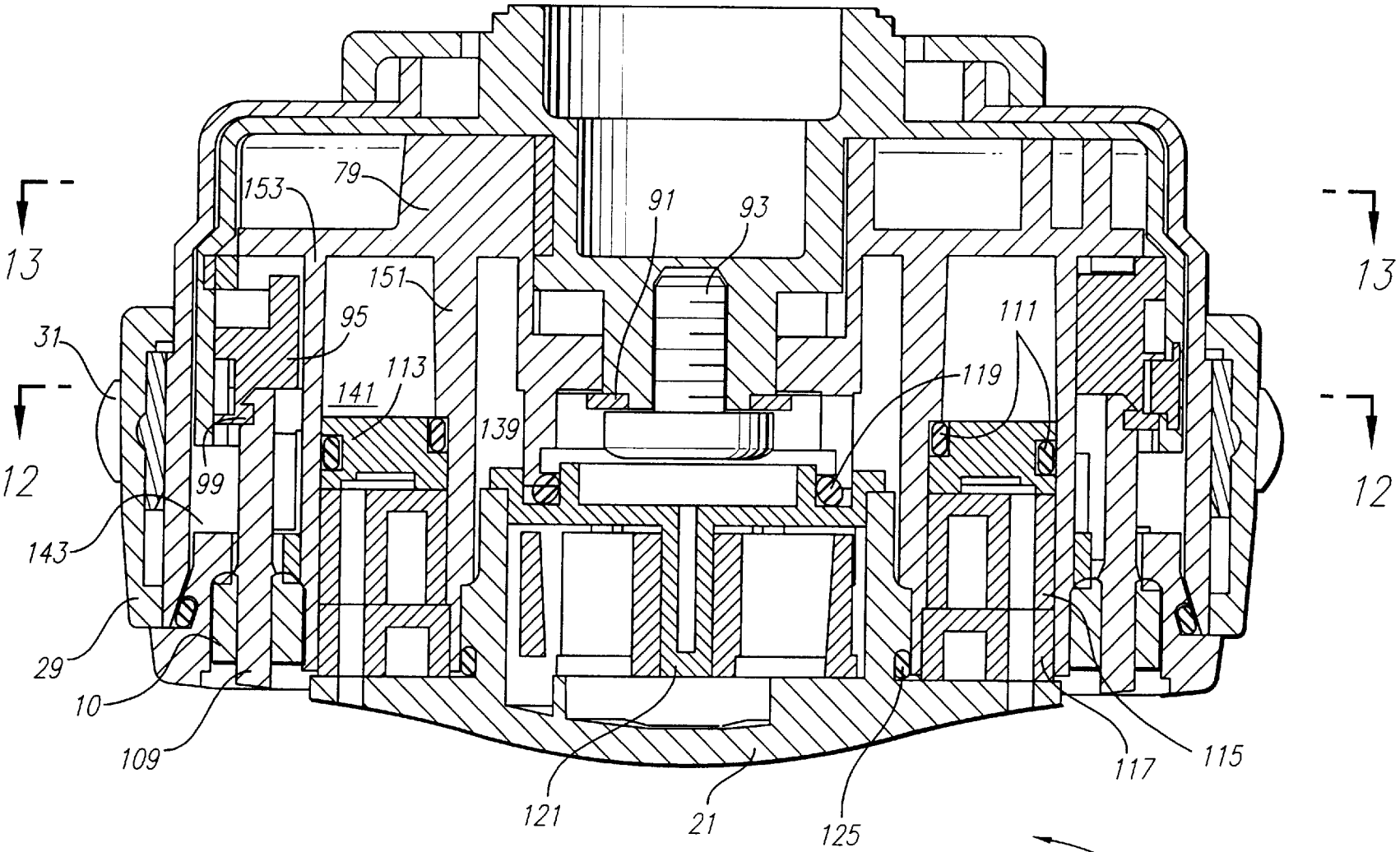
FIG. 11 is a cross-sectional view of the assembled shower head assembly of FIG. 10.

With reference to FIG. 1, a handheld shower unit 20 delivers water from a tube or pipe 23, or faucet (not shown) to a user. The pipe 23 or faucet forces water into a handle 27 that is angled to force the water downward through a handheld shower head 30 and out to the user through various apertures in a face 21. The handheld shower head 30 is generally cylindrical and includes one or more valves and other components as shown in FIG. 11, which is explained in detail below. The handheld shower head 30 is provided with an outer selector cover or selector ring cover 29 having selector cover knobs 31, which are shown here in sets of two, but can be placed in a variety of other ways. A spray ring 10 of the present invention is designed to be coupled axially to components within the handheld shower head 30.

Figure 2:
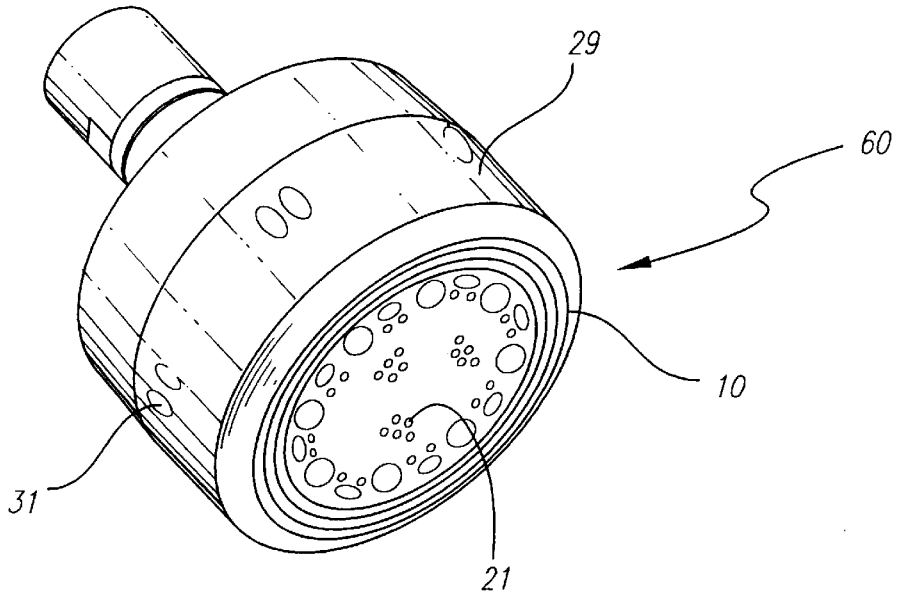
FIG. 2 is a perspective view of a fixed showerhead using a spray ring according to the present invention.

In FIG. 2, a fixed shower head 60 is shown having the outer selector cover 29 with the selector cover knobs 31, as in the handheld shower head 30 in FIG. 1. The spray ring 10 is provided surrounding the perimeter of a face 21 of the fixed shower head 60.

The spray ring 10 shown in FIGS. 3–6 is a generally cylindrical ring preferably formed of an elastomer material or other suitable elastic material. The spray ring 10 includes an inner ring or circumference 13 and an outer ring or circumference 15 molded to the inner ring 13. The molding provides a smooth upper edge 19. As shown in FIG. 4, a plurality of apertures 18 are located between the inner ring 13 and the outer ring 15. The apertures 18 have a generally oval shape, although other shapes may be used. The apertures 18 are used to accept and grip corresponding legs 110 of a spray ring retainer 109. The shapes of the apertures 18 and the legs 110 may be varied. The lower surface 17 of the spray ring 10 may include a further indentation molded therein for a faster hold on the spray ring retainer 109.

FIG. 5 shows an outer edge 25 of the outer ring 15 of the spray ring 10. The outer edge 25 includes a plurality of grooves defined therein. More particularly, three sets of grooves are alternately formed into the outer edge 25. The first set of grooves 39 are parallel to the axis of the spray ring 10. The grooves 39 maintain a constant width along the outer edge 25 of the outer ring 15. The second set of grooves 41 diverge outwardly from the upper edge 19. Preferably, the angle of divergence from the upper edge 19 to the lower edge 17 is approximately 4.5°. Further, the width of the second set of grooves 41 tapers inwardly from the upper edge 19 to the lower edge 17 to provide a varying width of spray as the height of the ring is adjusted. The third set of grooves 43 diverges outwardly from the upper edge 19 at a preferred angle of approximately 9°. The width of the grooves 43 tapers inwardly from the upper edge 19 to the lower edge 17.

FIG. 6 shows an inner edge 23 of the inner ring 13 of the spray ring 10. The inner ring similarly includes a plurality of grooves defined therein. Three sets of grooves are alternately formed into the inner edge 23. The first set of grooves 47 are parallel to the center axis of the spray ring 15. The second set of grooves 49 converge inwardly from the upper edge 19 at a preferred angle of approximately 1°. The third set of grooves 51 converge inwardly from the upper edge 19 at an angle of approximately 2°. The width of the grooves tapers inwardly from the upper edge 19 to the lower edge 17.

FIG. 3 shows the spray patterns produced by the spray ring 10 of the present invention. The grooves along the inner ring 13 force water inwardly to produce three rings of spray. The grooves along the outer ring 15 force water outwardly to produce three additional rings of spray. Water is directed from the shower head 30 or the fixed shower head 60 through each groove at the predetermined angle of the groove. Moreover, as the selector cover 29 moves the spray ring 10 upwardly, the force of the spray varies according to the taper of the groove. Thus, the force of the varying sprays can vary from coarse to needle, depending upon the width of the groove. Each inner and outer ring of spray is coaxial with the spray ring 10.

Figure 14:
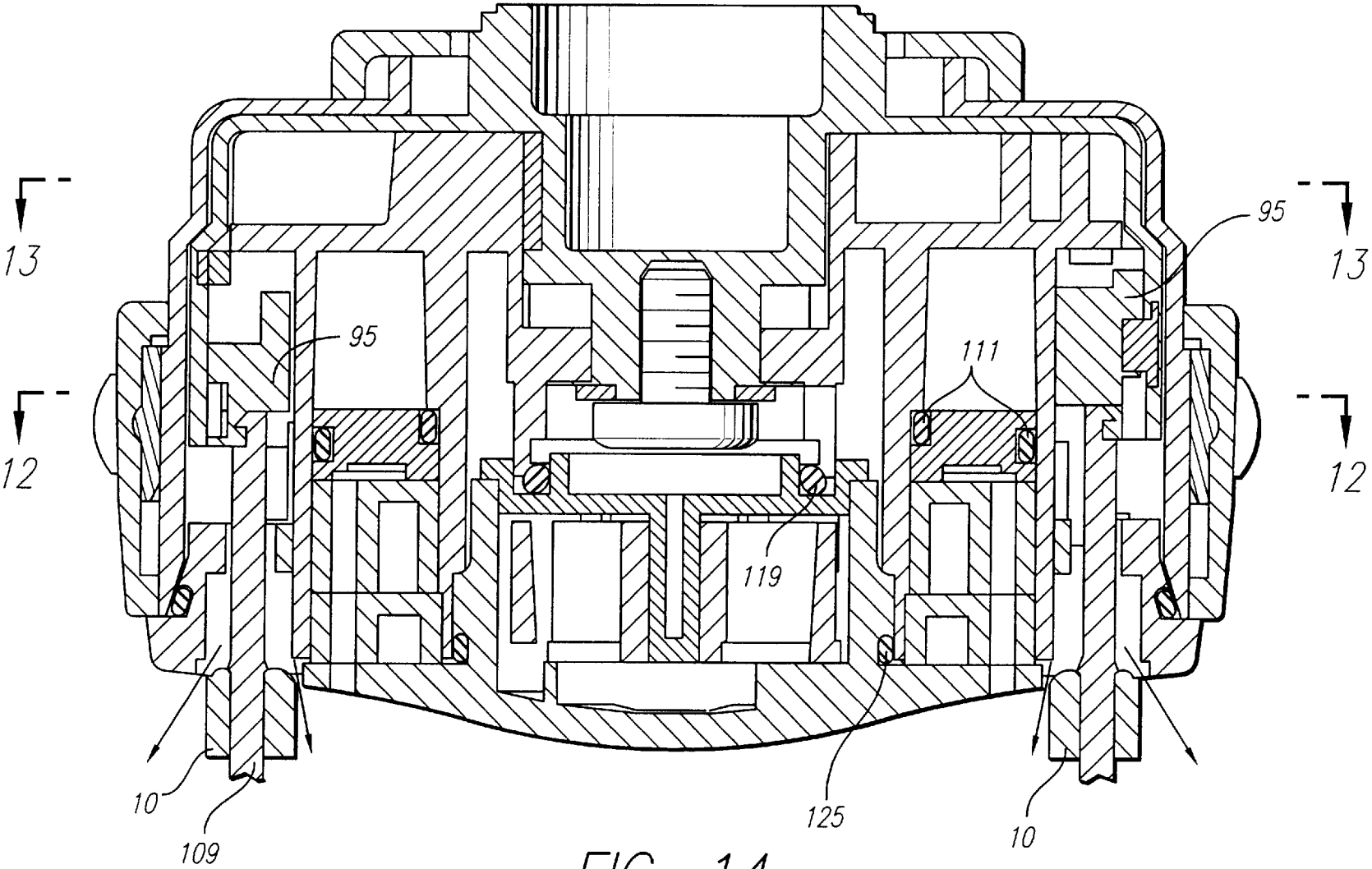
FIG. 14 is the shower head assembly of FIG. 11 with the spray ring in a flush position.

As shown in FIG. 14, the spray ring 10 can further be moved to a point substantially exterior to the shell 26. When the spray ring 10 is placed in this exterior position, the shower is placed in a "flush" position, allowing water to flow along the entire exterior and interior of the spray ring 10. Specifically, as discussed above, the spray ring 10 is formed of elastomer, a flexible resilient material that resists calcium deposits. In the "flush" position, the calcium deposits can be cleaned by water flowing from the shower head. Thus, the spray ring 10 need not be removed for cleaning.

Figure 7:
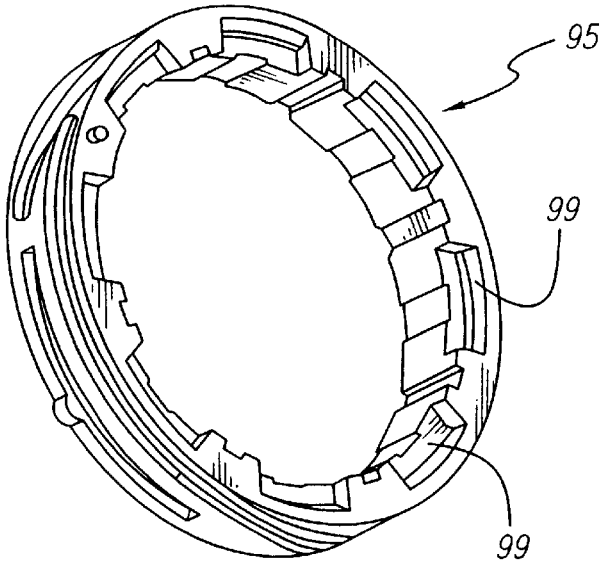
FIG. 7 is a plan view of a cam ring of the present invention.

FIG. 7 shows a cam ring 95 which has a plurality of snaps or undercuts 99 at substantially equal interval around the inner periphery of the cam ring 95. As it is explained in connection with FIG. 10 later, each snap 99 snaps and locks with the corresponding leg 110 of the spray ring retainer 109. Since the spray ring 10 is mounted on the spray ring retainer 109, this has the effect of operatively coupling the cam ring 95 and the spray ring 10 with each other.

Figure 8:
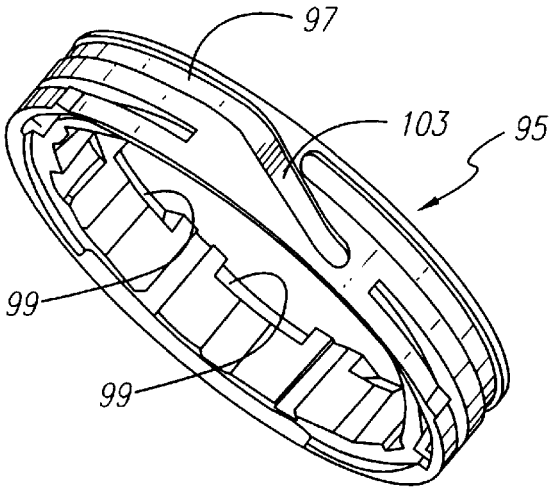
FIG. 8 is another plan view of the cam ring of FIG. 7 from another angle.

In FIG. 8, on the exterior peripheral surface of the cam ring 95, a track 97 is provided having a ramp portion 103. Shoulder pins 78 fit in the track 97 to couple a valve body 77 with the cam ring 95. As explained in connection with FIG. 10, rotation of the selector cover 29 can be translated into a lateral movement of the cam ring 95 and the spray ring 10, in a direction which is parallel to the direction of the water flow.

Figure 9:
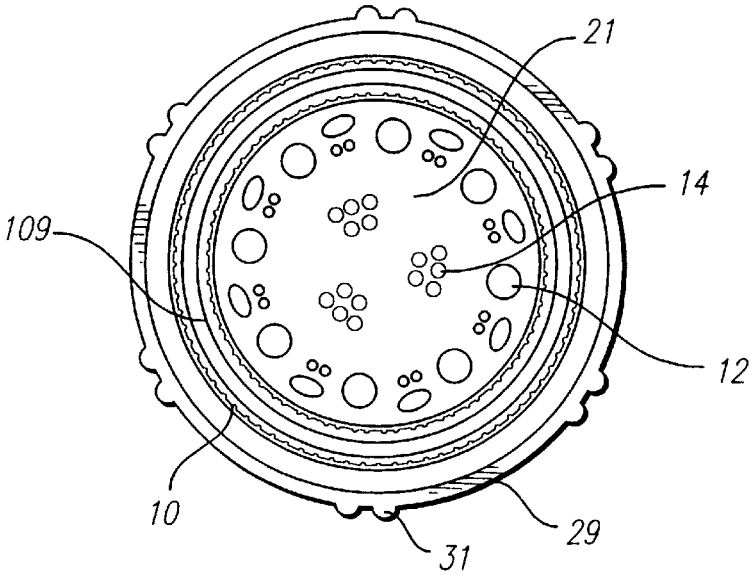
FIG. 9 is a bottom view of a face of a shower head assembly of the present invention.

In FIG. 9, a face view of the shower head of the shower head assembly 70 is shown. The face 21 defines aerated soft spray ports 12 and pulsating massage spray ports 14. Surrounding the face 21 is the spray ring 10, which is supported by a ring portion 108 of the spray ring retainer 109 so that the spray ring 10 is supported on the entire circular bottom thereof by the retainer 109 against the flow of water. The legs 110 go through the apertures 18 of the spray ring 10 to couple the spray ring 10 and the ring retainer 109.

Figure 10:
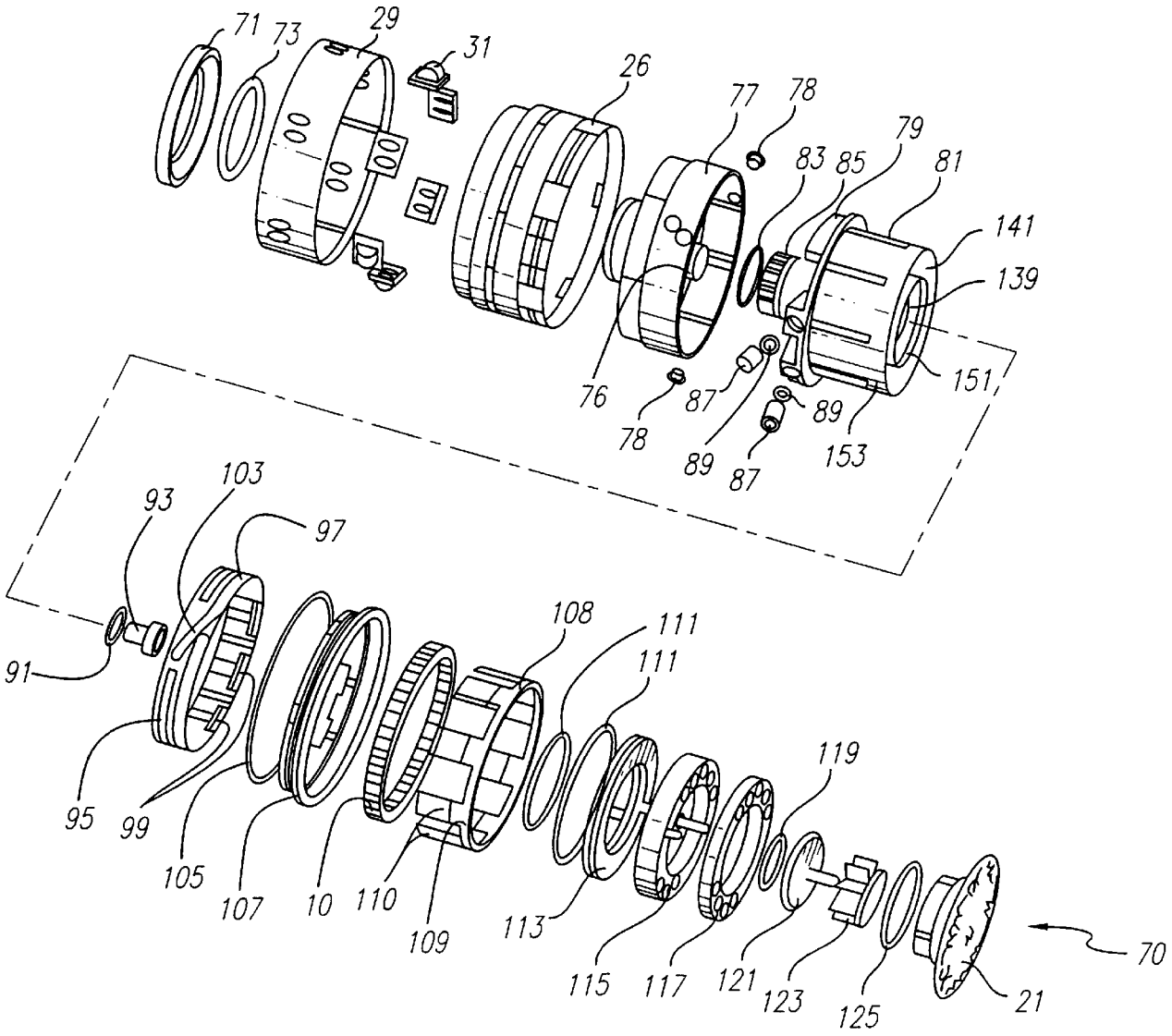
FIG. 10 is an exploded isometric view of the shower head assembly according to the present invention.

FIG. 10 shows an exploded view of a shower head assembly 70. The shower head assembly 70 can be incorporated into either the handheld type shower unit 20 or the fixed shower head 60 with minor design and dimension modifications. First, the shower head assembly 70 as shown in FIG. 10 includes a shower shell 26 which has a large opening in the direction of the water flow to accommodate the valve body 77, and couples with an O-ring 73 and a back-up washer 71 in the opposite direction where the shower shell 26 defines another circular but smaller aperture (not shown in FIG. 10). The selector ring cover 29 is disposed to fit over a lower portion of the shower shell 26. The selector cover knobs 31 are provided to protrude around the periphery of the selector ring cover 29 to provide easy traction for rotation even in a moist or wet environment.

Figure 13:
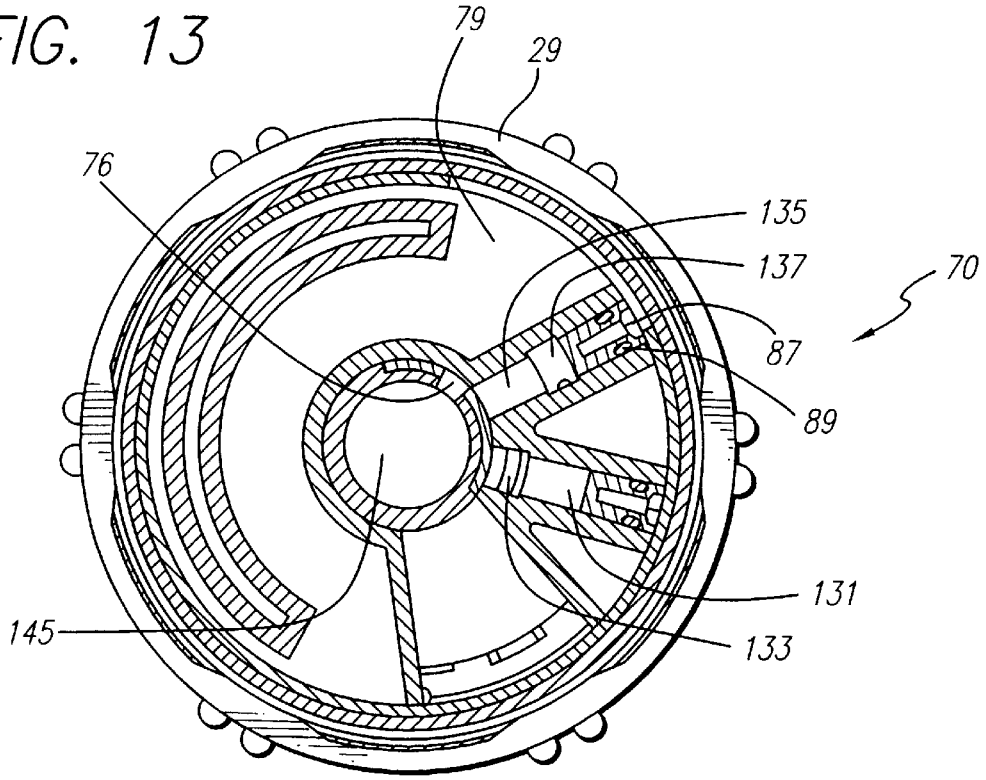
FIG. 13 is another cross-sectional view of the shower head assembly of FIG. 11 at line 13—13.

The valve body 77 accommodates a selector disk 79 with an O-ring 83 and a Polymod seal 85 provided therebetween. The selector disk 79 is attached to a transfer housing 81, and has first and second water passages 131, 135 as shown in FIG. 13. The water passages 131, 135 are plugged at the outer ends using O-rings 89 and plugs 87. Water flow will be explained later in connection with FIGS. 11–13. The transfer housing 81 coupled with the selector disk 79 has inner and outer cylindrical walls 151, 153 and defines a first chamber 139 and a second chamber 141, as well as a third chamber 143. The third chamber 143 accommodates the operating 10 and its accompanying parts.

The transfer housing 81 slidably fits through the cam ring 95. The transfer housing 81 has ridges 82 on its outer peripheral surface, or the outer wall, 153 and the cam ring 95 has channels on its interior circumference at the same interval as the transfer housing ridges 82 so that the transfer housing 81 and the cam ring 95 are locked in a way that they do not rotate with respect to each other but are free to slide in the lateral direction, the direction parallel to the water flow, with respect to each other.

The cam ring 95 defines the plurality of undercuts or snaps 99 at a predetermined interval with each other to snap together with the corresponding legs 110 of the spray ring retainer 109. The cam ring 95 is also provided with a channel-like track 97 which winds around the outer periphery of the cam ring 95, and one of its ends defines the ramp 103. The three shoulder pins 78, disposed substantially at every 120° around the circumference of the valve body, fit in the apertures defined in the valve body 77 and their ends engage in the track 97 of the cam ring 95. When the selector ring cover 29 is rotated by a user, it causes the cam ring 95 to be rotated. The cam ring 95 stays in its normal lateral position until one of the shoulder pins 78 hits the ramp 103, at which time the cam ring 95 is pushed out laterally toward the outlet of the shower head assembly 70. Since the spray ring 10 and its retainer 109 are connected to the cam ring 95, they move with the cam ring 95. Turning the selector ring cover 29 clockwise causes the spray ring 10 to move out all the way to the flush position where water-born particles and sediments are flushed out. The spray ring 10 can be retracted back to fine or coarse spray positions by partially turning the selector ring cover 29 counter-clockwise.

An O-ring 105 and a connecting bridge 107 are disposed between the inner/outer spray ring 10 and the cam ring 95. On the opposite side of the inner/outer spray ring 10 and its retainer 109, additional O-rings 111, and an accelerator ring 113 are disposed. Further toward the outlet, a turbulent ring 115, an aeration spacer 117, and another O-ring 119 are disposed. Then finally, within a cylindrical end of the face 21 which faces away from the outlet, a rotor cover 121, a rotor 123 which fits over a portion of the rotor cover 121 and an O-ring 125 are disposed.

Figure 12:
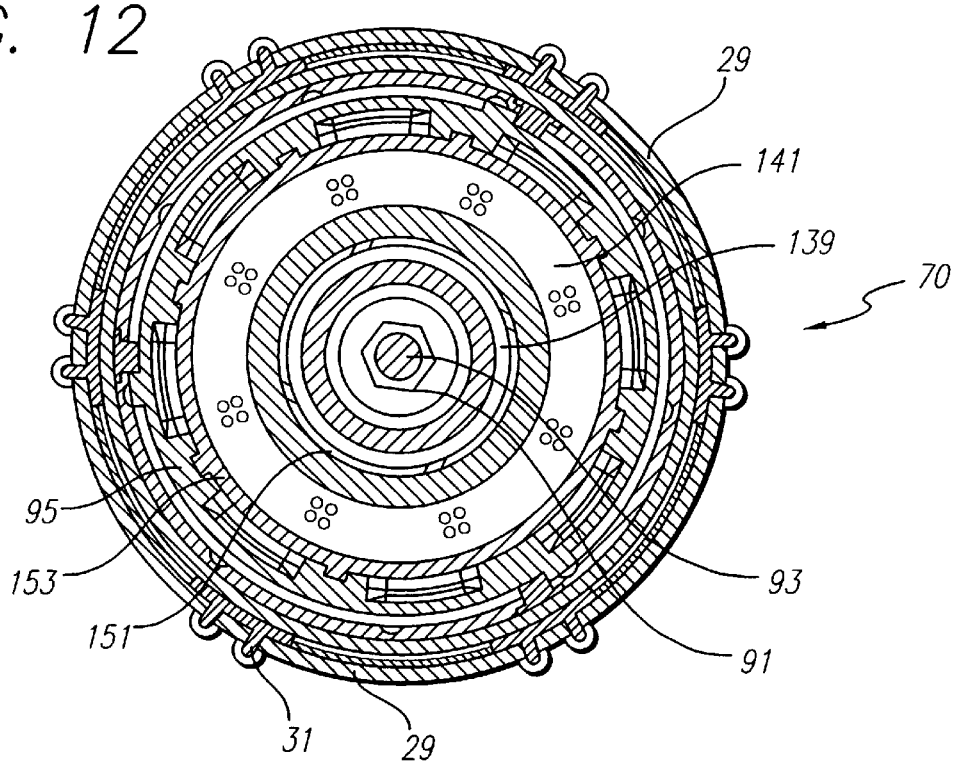
FIG. 12 is a cross-sectional view of the shower head assembly of FIG. 11 at line 12—12.

In FIG. 11, the shower head assembly 70 shown in the exploded view in FIG. 10 is shown assembled together in the normal operative condition. Cross-sections of the shower head assembly 70 at lines 12—12 and 13—13 are shown in FIGS. 12 and 13, respectively. The valve body 77 defines a water intake chamber 145 and a port 76. A water passage can be established by manipulating the position of the selector disk 79 with respect to the valve body 77 to align the port 76 to one of the water passages. First, when the selector ring cover 29 is rotated clockwise, an aerated soft spray is produced from the aerated soft spray ports 12. This spray is to be distinguished from a soft spray produced by the spray ring 10. When the selector ring cover 29 is rotated further clockwise, a pulsating massage spray is produced from the pulsating massage spray ports 14 at first slowly and, as the selector ring cover 29 is rotated further, more strongly and faster. When the selector ring cover 29 is even further rotated clockwise, the flow starts to come from adjacent the spray ring 10, at first, as needle spray or strong spray, and then, as coarse or softer spray. Then, finally when the selector ring cover 29 is completely rotated clockwise, the spray ring 10 is moved out to the flush position. If the selector ring cover 29 is rotated in the reverse direction, i.e., counterclockwise, the order of the types of flow produced will be reversed from what has been described above.

The flow to the aerated soft spray ports 12 is established when the selector disk 79 and the valve body 77 are aligned in such away so that the port 76 in the valve body 77 communicates with the second water port 137, and the flow is established to the second chamber 143. The pulsating massage spray is produced when the port 76 of the valve body 77 communicates with the first water port 133 and the water flows to the first chamber 139. Finally, a flow to the third chamber 143 and to the spray ring 10 is produced through a space between the valve body 77 and the selector disk 79.

For aerated soft spray, the acceleration ring 113 first produces a high water velocity. When the flow of water hits the turbulent ring 115, the turbulent ring 115 with its various small passages pointing in various directions provides a turbulent flow as well as aeration of the water. Next, the aeration spacer 117 guides or aligns the water flow.

Having thus described a preferred embodiment of a shower fixture having a spray ring, it should be apparent to those skilled in the art that certain advantages of the system have been achieved. It should also be appreciated that various modifications, adaptations, and alternative embodiments thereof may be made within the scope and spirit of the present invention.

What is claimed is:

1. A shower fixture comprising:

a spray ring retainer having a ring portion and a plurality of extensions extending from the ring portion; and a spray ring including an outer circumference, an inner circumference, a plurality of outer grooves disposed along the outer circumference, a plurality of inner grooves disposed along the inner circumference, and a plurality of apertures disposed circumferentially in the spray ring between the inner and outer circumferences, wherein the extensions extend through the apertures in the spray ring so that the ring portion of the spray ring retainer supports the spray ring.

2. A shower fixture as recited in claim 1, comprising means for coupling the spray ring to a shower unit.

3. A shower fixture as recited in claim 1, wherein the plurality of inner grooves are capable of directing water inward from the spray ring.

4. A shower fixture as recited in claim 1, wherein some of the plurality of outer grooves have a generally tapering shape.

5. A shower fixture as recited in claim 1, wherein the plurality of inner grooves comprise a first set of inner grooves capable of directing water at a first predetermined angle.

6. A shower fixture as recited in claim 5, wherein the plurality of inner grooves comprise a second set of inner grooves capable of directing water at a second predetermined angle.

7. A shower fixture as recited in claim 6, wherein the plurality of inner grooves comprise a third set of inner grooves capable of directing water at a third predetermined angle.

8. A shower fixture as recited in claim 1, wherein the spray ring is formed of a flexible resilient material.

9. A shower fixture as recited in claim 1, wherein the spray ring is formed of elastomer.

10. A shower assembly comprising:

a spray ring having an outer ring having a plurality of outer grooves disposed along an outer edge thereof, an inner ring coupled to the outer ring and having a plurality of inner grooves disposed along an inner edge thereof, and a plurality of apertures disposed between the outer ring and the inner ring for coupling the spray ring to the shower assembly; and a spray ring retainer for supporting the spray ring against a force of water flow around an entire circular bottom of the spray ring, the spray ring retainer having a plurality of legs for coupling with the spray ring through the apertures in the spray ring, wherein the plurality of outer grooves are capable of directing water outward from the spray ring, and wherein the plurality of inner grooves are capable of directing water inward from the spray ring.

11. A shower assembly as recited in claim 10, wherein the plurality of inner grooves comprise at least two sets of inner grooves capable of directing water at first and second predetermined angles respectively.

12. A shower assembly comprising:

a shower shell coupled to a water source, the shell permitting a flow of water therethrough;

a selector cover rotatably coupled to an outer edge of the shower shell;

a cam ring disposed within the shower shell and coupled to the selector cover such that axial rotation of the selector cover moves the cam ring in a direction parallel to an axis of the shell;

a spray ring retainer coupled to an end of the cam ring; and a spray ring coupled to the spray ring retainer, the spray ring having a plurality of inner grooves along an inner circumference and a plurality of outer grooves along an outer circumference, wherein axial rotation of the selector cover causes a movement of the spray ring in the direction parallel to the axis of the shell, and wherein the cam ring retainer supports the cam ring over the entire-circular bottom thereof.

13. The shower assembly, as recited in claim 12, wherein the spray ring is movable to a position outside of the shell for removing deposits from the spray ring.

14. The shower assembly, as recited in claim 13, wherein the plurality of inner grooves includes a first set of inner grooves angled at a first predetermined direction.

15. The shower assembly, as recited in claim 14, wherein the plurality of inner grooves includes a second set of inner grooves angled at a second predetermined direction.

16. The shower assembly, as recited in claim 15, wherein the plurality of inner grooves includes a third set of inner grooves angled at a third predetermined direction.

* * * * *